United States Patent [19]

Dochterman

[11] 3,936,240

[45] Feb. 3, 1976

[54] CENTRIFUGAL-VORTEX PUMP

[75] Inventor: Richard W. Dochterman, Fort Wayne, Ind.

[73] Assignee: General Electric Company, Fort Wayne, Ind.

[22] Filed: Mar. 25, 1974

[21] Appl. No.: 454,046

[52] U.S. Cl. ..... 417/368; 415/143; 415/213 T; 416/175; 417/244; 417/423 A

[51] Int. Cl.² ..... F04B 39/06; F04D 17/12

[58] Field of Search .. 415/53 T, 213 T, 143, 55–58; 416/175; 417/244, 423 A, 368

[56] References Cited

UNITED STATES PATENTS

| | | | |
|---|---|---|---|
| 1,861,839 | 6/1932 | Burks | 415/213 T |
| 1,867,651 | 7/1972 | Burks | 415/53 T |
| 1,867,652 | 7/1932 | Burks | 415/213 T |
| 2,208,057 | 7/1940 | Skitch | 415/213 T |
| 2,350,839 | 5/1961 | Szydlowski | 415/53 T |
| 2,982,986 | 5/1961 | Tupper | 415/143 |
| 2,983,432 | 5/1961 | Tupper | 415/53 T |
| 3,545,890 | 12/1970 | Hubbard et al. | 415/53 T |

*Primary Examiner*—C. J. Husar

*Attorney, Agent, or Firm*—Ralph E. Krisher, Jr.

[57] ABSTRACT

A pump having centrifugal and vortex impellers mounted on a common rotor member. Impellers are mounted on opposite sides of rotor and make maximum use of rotor diameter. Fluid follows a serial path through the centrifugal and vortex impellers. The vortex impellers rotate in a vortex channel divided into one or more sections, plural sections of which may be arranged in parallel flow relation. The casing surrounding the rotor member may form the necessary inlet, outlet, and internal fluid channels for the pump.

12 Claims, 13 Drawing Figures

HEAD IN $H_2O$
150
140
130
120
110
100
90
80
70
60
50
40
30
20
10
0
10
20
30
40
50
60
70
80
90
100
AIRFLOW - CFM
118
120
121
122

HEAD IN $H_2O$
110
100
90
80
70
60
50
40
30
20
10
0
10
20
30
40
50
60
70
80
90
100
AIRFLOW - CFM
124
126

CENTRIFUGAL-VORTEX PUMP

BACKGROUND OF THE INVENTION

Field of the Invention

This invention relates generally to pumps of the combined centrifugal-vortex type, and more particularly to pumps incorporating one or more vortex impeller paths arranged in series flow relation with at least one centrifugal pump flow path.

U.S. Pat. Nos. 2,982,986 and 2,983,432 both to Myron D. Tupper, and both assigned to the assignee of the present application, disclose blowers of the combined centrifugal-vortex impeller type incorporated in a vacuum cleaner, the objective in each case being to provide a blower combining the relatively low head and high flow characteristics of a centrifugal impeller with the high head and low flow characteristics of a vortex impeller.

Conventional vortex impellers, such as those incorporated in the above-referred to Tupper patents, employ a single, annular vortex channel thus providing a vortex airflow path of substantial length. The rate of flow and efficiency of such conventional vortex impellers are limited by reason of friction losses due to the length of the vortex airflow path.

It is desirable to provide a blower or pump of the combined centrifugal-vortex impeller type having increased efficiency and also having a higher flow characteristic without a corresponding reduction in head generating capability.

It is accordingly an object of the invention to provide an improved pump of the combined centrifugal-vortex impeller type.

Another object of the invention is to provide an improved pump of the combined centrifugal-vortex impeller type employing multiple vortex paths.

Yet another object of the invention is to provide a centrifugal-vortex impeller pump wherein both the centrifugal and vortex impeller blades may be of the same outer diameter when desired, or may fully utilize the impeller's maximum diameter.

Still another object of the invention is to provide a pump with a substantial increase in the flow rate capability and efficiency thereof without a significant reduction in head capability.

Summary of the Invention

In carrying out at least some of the above and other objects in one preferred form, I provide a combined centrifugal-vortex impeller pump in which the annular vortex channel is divided into a plurality of sections each receiving air or other fluid medium from the centrifugal impeller and having fluid discharged therefrom. This arrangement in effect can change the length of each vortex flow path inversely proportionally to the number of vortex channel sections employed and thus increase the flow and efficiency characteristics of the pump without significantly reducing the head generating capability of the pump.

In the illustrated embodiments of the invention, the centrifugal-vortex impeller is built around a disc or rotor having two sides. The centrifugal fan blades are carried on one side of the disc while the vortex fan blades are carried on the other side. The vortex blades are positioned along the outer periphery of the disc, thus taking advantage of the maximum diameter of the disc. The centrifugal blades also extend to the outer periphery of the disc, thereby being as long as permitted by the disc diameter and being capable of moving a greater volume of fluid. Since the vortex blades are on the outer periphery of the disc also, they will rotate at a higher velocity than would be the case if they were closer to the center of the disc, and in turn create a relatively higher head. By this construction of the impeller, higher head and flow can be achieved with a relatively small diameter pump. In addition, by designing the impeller as one unit the construction thereof may be both economical and simple.

One preferred embodiment is illustrated herein that includes a multiple path vortex pump including a casing with a rotor member therein having a centrifugal impeller thereon. The casing has an inlet opening therein for admitting air or other gaseous or liquid medium to the centrifugal impeller and a first portion forming an exhaust plenum chamber for the centrifugal impeller. The rotor member has a plurality of blade elements thereon forming a vortex impeller, the casing also having a second portion forming an annular vortex channel for the vortex impeller. Means are provided for dividing the vortex channel into a plurality of sections, and the casing has a plurality of passages formed therein respectively communicating between the plenum chamber and the vortex channel sections for admitting fluid medium from the plenum chamber to the vortex channel sections. The second casing portion has a plurality of exhaust openings therein for respectively discharging fluid medium from the vortex channel sections.

The above-mentioned and other features and objects of this invention and various manners of attaining them will become more apparent, and the invention itself will be best understood by reference to the following description of different embodiments of the invention taken in conjunction with the accompanying drawings.

DESCRIPTION OF THE PREFERRED EMBODIMENT

Figure 1:
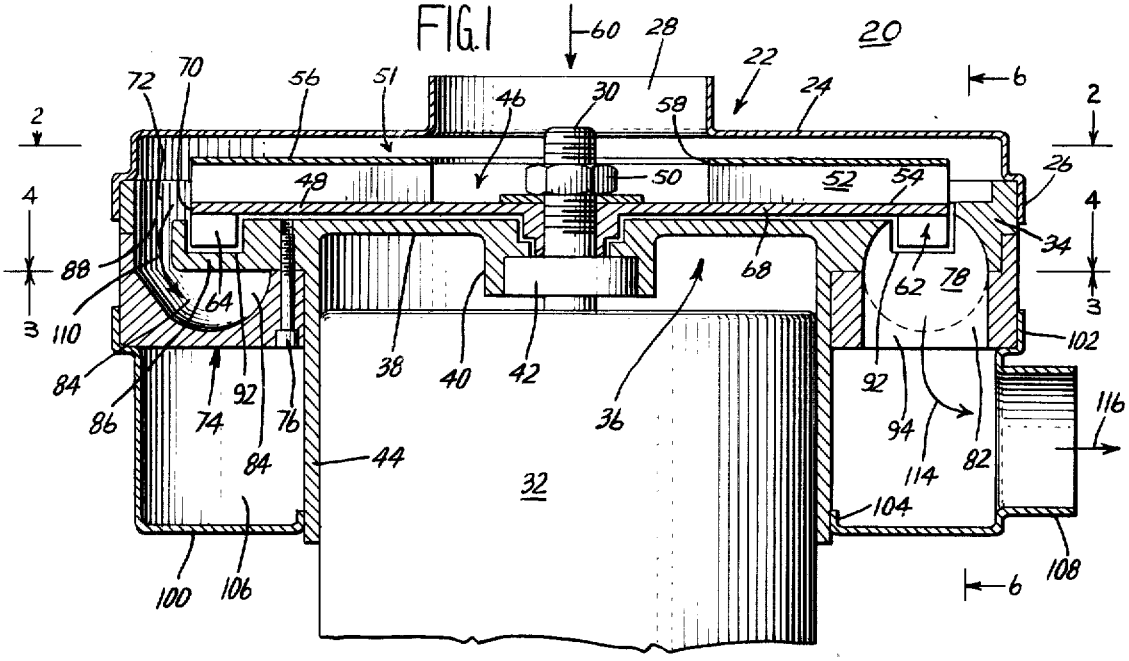
FIG. 1 is a side cross-sectional view showing a multiple path vortex pump embodying one form of the invention the view being taken generally along the line 1—1 of FIG. 2.
Figure 2:
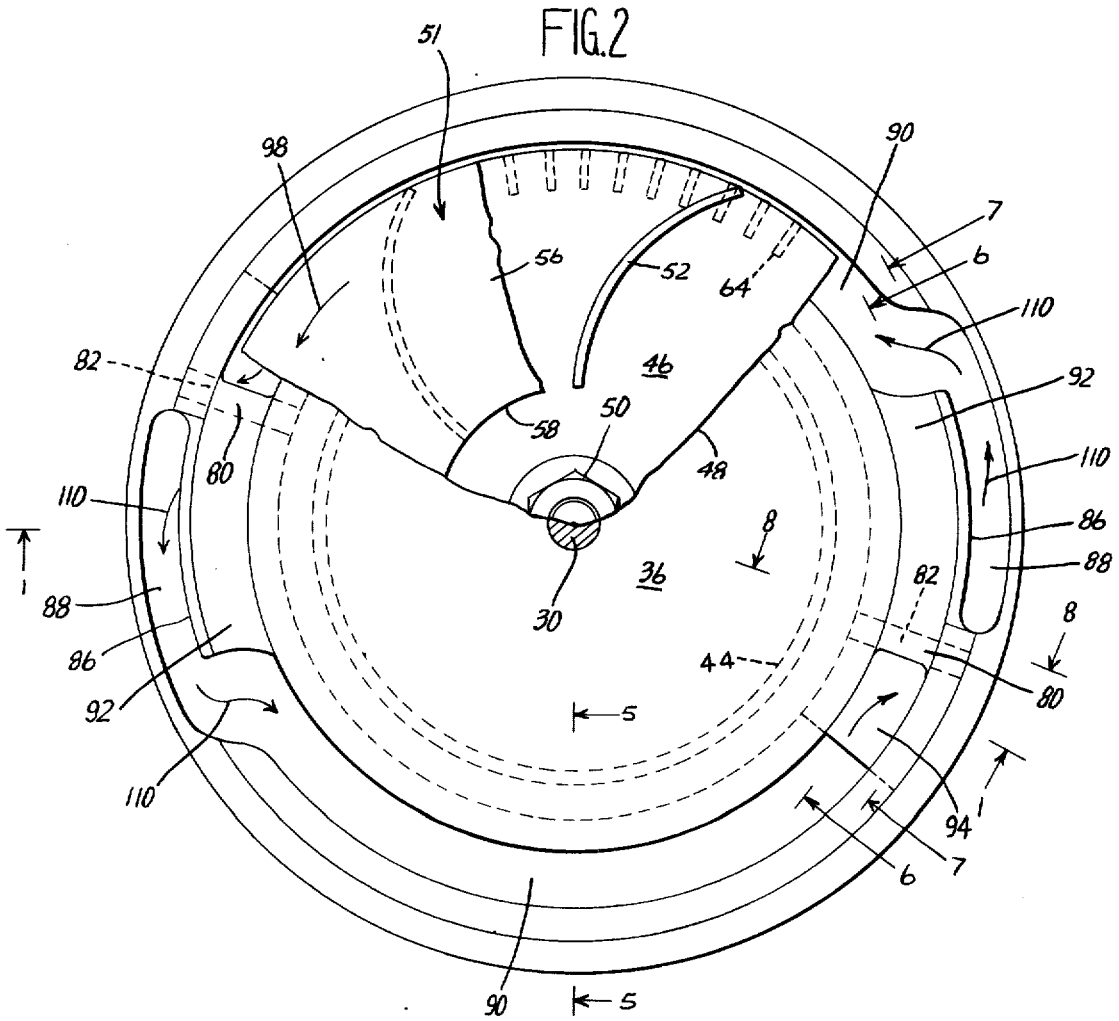
FIG. 2 is a top view, partially in cross-section and partly broken away, showing a top casing member and impeller assembly with a cover member removed, taken generally along the line 2—2 of FIG. 1.

Referring now to FIGS. 1 through 8 of the drawings, one form of an improved multiple path vortex pump, embodying the invention in one form thereof, is generally indicated at 20 and comprises a cover member 22 (which may be of sheet steel, for example) having a top wall 24 and an annular side wall 26. Inlet opening 28 is formed in top wall 24 coaxial with a shaft 30 of a motor 32. Annular side wall 26 of cover member 22 engages annular side wall 34 of a top casing member 36 which may be formed of cast aluminum. Inner portion 38 of top casing member 36 has a hub portion 40 formed thereon in which a bearing 42 for shaft 30 is seated. Annular flange 44 depends from inner portion 38 of the top casing member 36 and engages motor 32.

Impeller assembly 46 comprises a rotor disc 48 which may be formed of aluminum or other suitable material and which is secured to shaft 30 by a threaded fastener 50. Centrifugal impeller 51 comprising centrifugal impeller blades 52 is mounted on the top side 54 of disc 48 as viewed in FIG. 1. Centrifugal impeller blades 52 are connected by an annular ring 56, formed of relatively thin sheet metal such as aluminum, which has a central opening 58 communicating with centrifugal impeller blades 52. It will be seen that inlet opening 28 in cover member 22 admits air or other gaseous or liquid medium to centrifugal impeller 51, as shown by arrow 60. A vortex impeller 62 comprises a plurality of vortex impeller blades 64 and is mounted on the bottom side of disc 48 adjacent its outer periphery 70. It will be understood that the vortex impeller blade 64 may be at an angle with respect to disc 48 although they are arranged in a perpendicular relationship in the embodiment shown in FIG. 1. Outer periphery 70 of disc 48 and the outer ends of centrifugal impeller blades 52 are spaced from the annular side wall 26 of cover member 20 and the annular side wall 34 of top casing member 36; and an exhaust plenum chamber 72 for the centrifugal impeller 51 is formed adjacent a baffle member 86.

Figure 3:
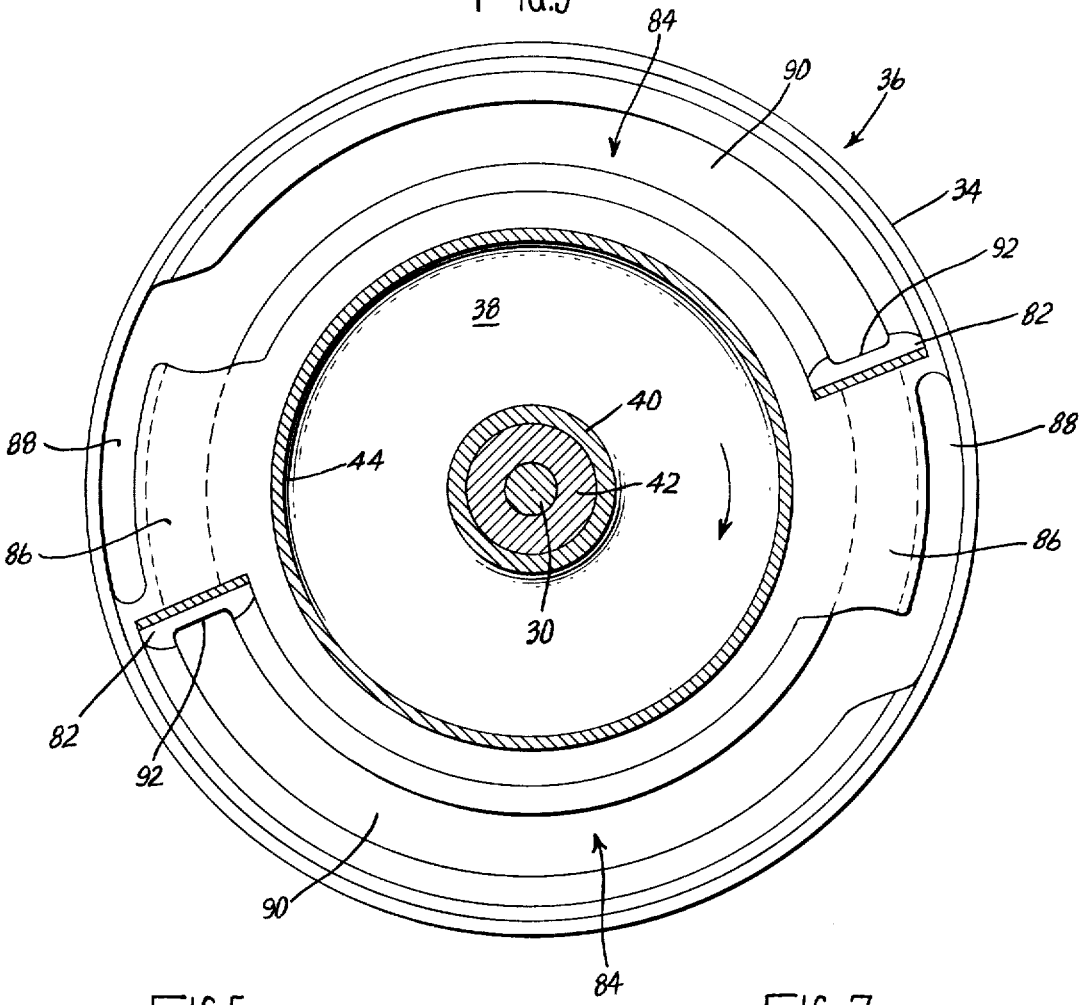
FIG. 3 is a bottom view of the top casing member taken generally along the line 3—3 of FIG. 1.
Figure 5:
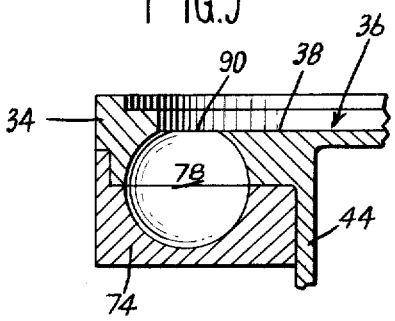
FIG. 5 is a fragmentary cross-sectional view taken generally along the line 5—5 of FIG. 2.
Figure 7:
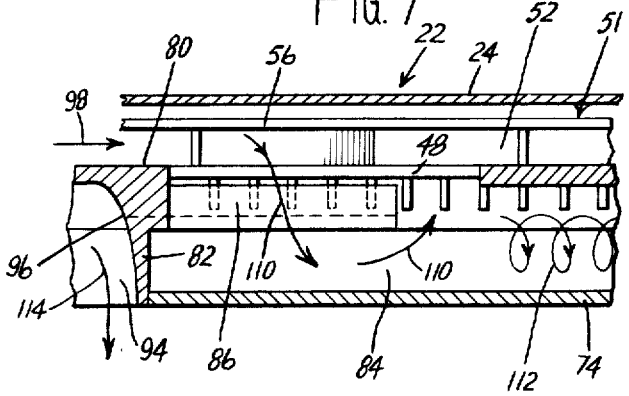
FIG. 7 is a fragmentary cross-sectional view taken generally along the line 7—7 of FIG. 2.
Figure 8:
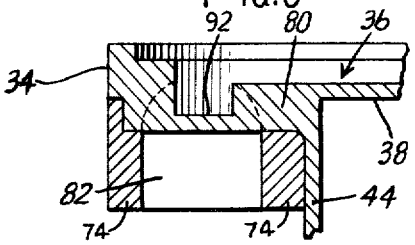
FIG. 8 is a fragmentary cross-sectional view taken generally along the line 8—8 of FIG. 2.
Figure 4:
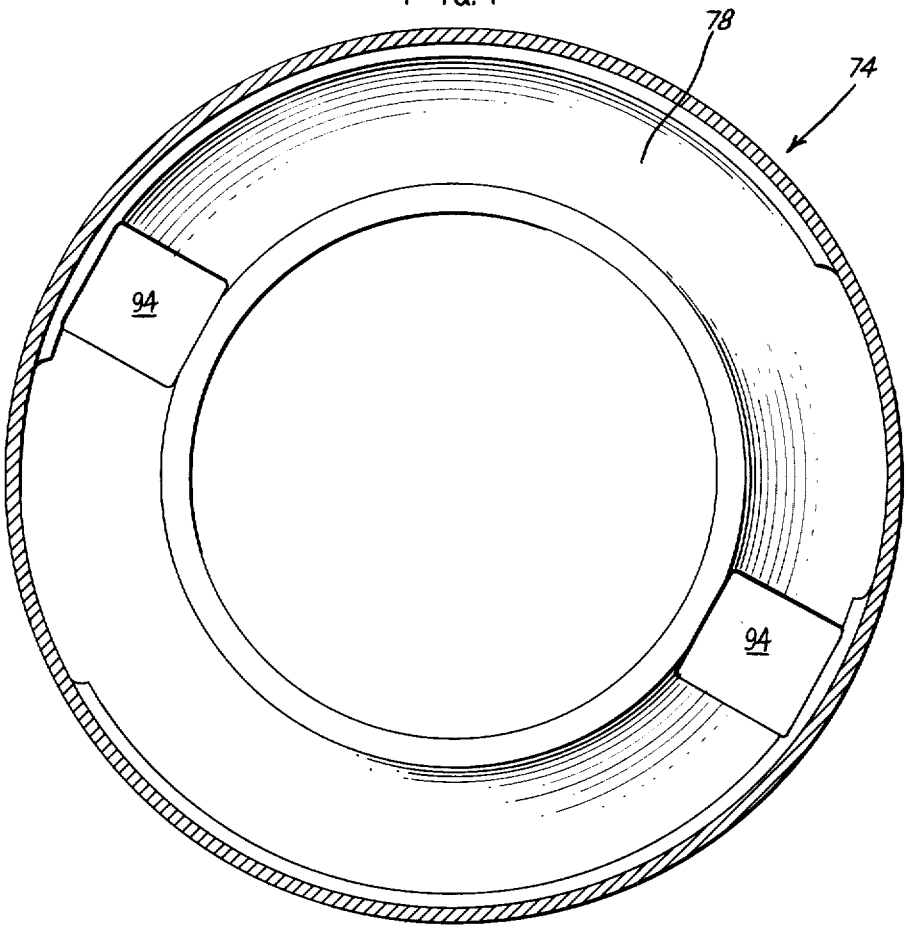
FIG. 4 is a top view of a bottom casing member taken generally along the line 4—4 of FIG. 1.
Figure 6:
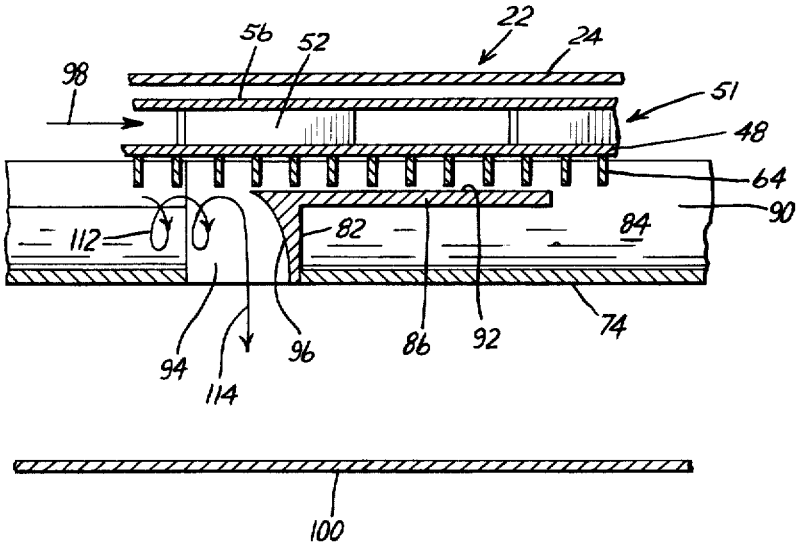
FIG. 6 is a fragmentary cross-sectional view taken generally along the lines 6—6 of FIGS. 1 and 2.

Bottom casing member 74, which may also be formed of cast aluminum, is secured to top casing member 36, for example as by threaded fasteners 76. Annular vortex impeller channel 78 is mutually formed in top and bottom casing members 36, 74. Inner portion 38 of top casing member 36 is joined to annular side wall 34 by diametrically opposite bridging portions 80. Partitions 82 are integrally formed on and depend from bridging portions 80 of top casing member 36. The partitions 82 extend into and across annular vortex channel 78. These partitions 82 divide channel 78 into two part-annular vortex channel sections 84 of equal length (FIG. 3). Baffle portions 86 are respectively integrally joined to bridging portions 80 and inner portion 38 of top casing member 36 and are respectively spaced from annular side wall 34 to define passages 88 communicating between centrifugal impeller exhaust plenum chamber 72 and vortex channel sections 84. Annular slots 90 respectively communicating with vortex channel section 84 are defined between inner portion 38 and annular side wall 34 of top casing member 36, slots 90 extending between bridging portions 80 and baffle portions 86. Vortex impeller blades 64 extend through slots 90 into vortex channel sections 84. Annular grooves 92 are respectively formed in baffle portions 86 and bridging portions 80, vortex impeller blades 64 extending into grooves 92. It will thus be seen that blades 64 of vortex impeller 62 move along slots 90 and grooves 92.

Passages 88 respectively communicate with vortex channel sections 84 adjacent one end thereof formed by a respective partition 82. Discharge openings 94 are formed in bottom casing member 74 respectively communicating with vortex channel sections 84 adjacent the other ends thereof defined by the respective partitions 82 remote from passages 88. Partitions 82 extend into openings 94 and have curved or scoop-shaped front surfaces 96 facing opposite the direction of impeller rotation, as shown by arrows 98 (see FIG. 7).

Annular manifold member 100 has an annular side wall 102 engaging the bottom casing member 74 and a re-entrant flange portion 104 engaging the annular flange 44 of top casing member 36. Discharge openings 94 communicate with manifold member 100 which thus forms exhaust plenum chamber 106 for the vortex impeller section. Side wall 102 of manifold member 100 has exhaust opening 108 formed therein.

It will be seen that with motor 32 rotating impeller assembly 46 in the direction shown by arrow 98, air or other gaseous or liquid medium will be drawn into inlet opening 28 in cover member 22 by centrifugal impeller 51 and discharged into plenum chamber 72. The air or other fluid medium under pressure in plenum chamber 72 flows through passages 88 into vortex channel sections 84, as shown by arrows 110 in FIG. 1, and a helical motion is imparted thereto in vortex channel sections 84 by vortex impeller 62, as shown by arrows 112. Additional pressure is imparted to the air or other fluid medium in vortex channel sections 84 by vortex impeller 62 and upon reaching partitions 82, the air or other gaseous or liquid medium is discharged into exhaust plenum chamber 106 through discharge openings 94, as shown by arrows 114, being finally exhausted from manifold 100 as shown by arrow 116.

Figure 9:
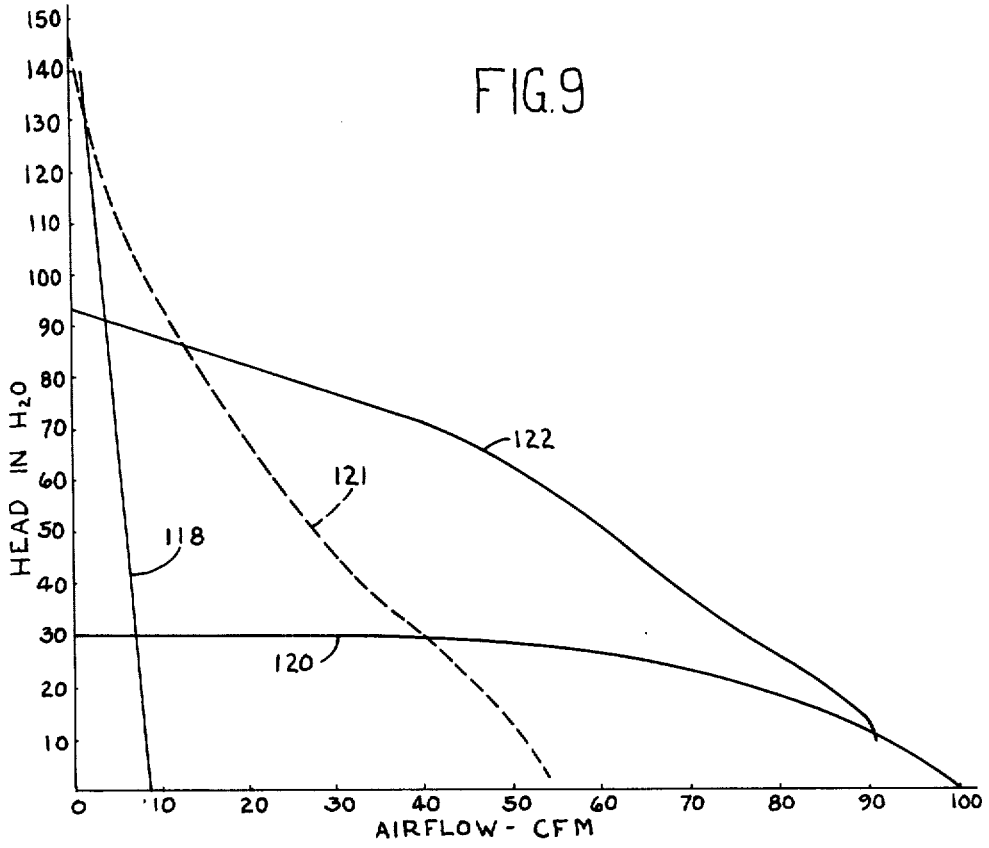
FIG. 9 shows head-flow curves for conventional vortex and centrifugal impellers and for an improved double path vortex pump embodying the invention; in ore form thereof.

Referring now to FIG. 9, a typical head-flow characteristic curve for a single path vortex impeller is shown at 118 and a typical head-flow characteristic curve for a single stage centrifugal impeller is shown at 120. The characteristic shown at 122 is provided by an improved centrifugal double path vortex pump embodying the invention in one form, with an impeller diameter of 5⅛ inches at speeds ranging from 16,400 to 18,400 r.p.m., and with watts input to the impeller (as distinguished from watts input to motor 32) varying from 930 to 1115. Maximum efficiency of approximately 35 percent was obtained at a flow rate of 56 c.f.m. with a head of 55 inches of water, a speed of 16,200 r.p.m., and watts input of approximately 1050. This may be contrasted with experience that has shown that an efficiency in the neighborhood of only about 23 percent under similar conditions would be expected with blower assemblies utilizing a single path vortex section.

Figure 10:
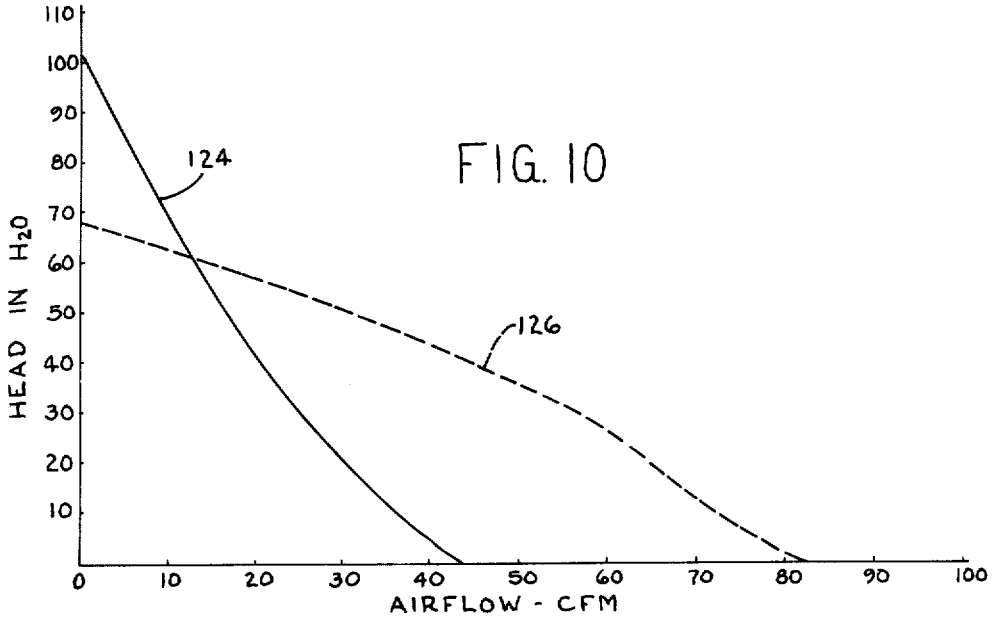
FIG. 10 shows head-flow curves for single and double channel vortex impellers.

It will be understood that the multiple vortex channel vortex pump described above may be used alone in some applications without using a centrifugal impeller in conjunction therewith. Referring to FIG. 10 of the drawings, a typical head-flow characteristic curve for a single channel vortex pump is shown at 124, and a typical curve for a double channel vortex impeller is shown at 126. It is now believed that a double channel vortex pump is capable of providing a significant improvement in efficiency as compared to a single path vortex pump.

Figure 11:
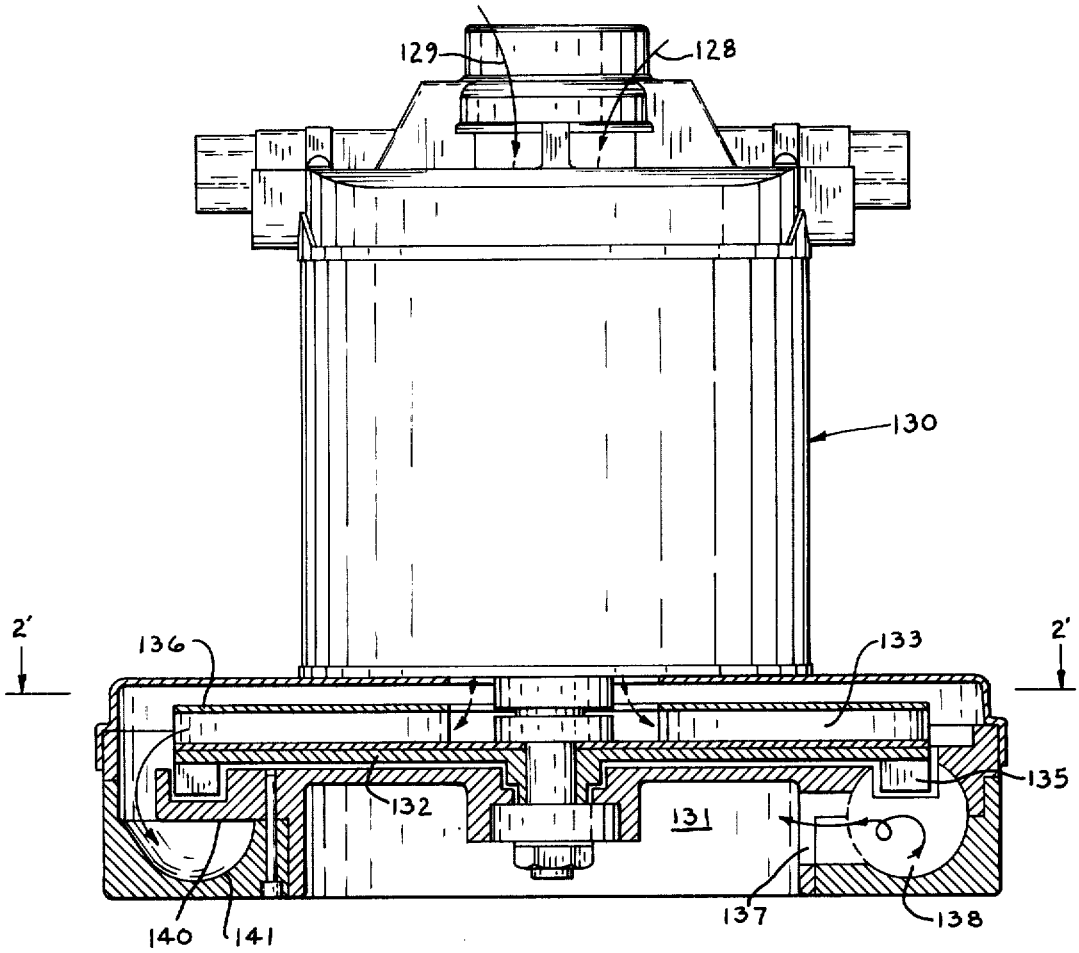
FIG. 11 is a cross-sectional view showing a construction embodying my invention with fluid flowing through a drive motor thus simultaneously cooling the motor.

FIG. 11 shows a motor 130 and multiple path vortex pump 131 in a configuration that differs from the embodiment illustrated in FIG. 1. The direction in which the view of FIG. 11 is taken is similar to the direction of FIG. 1 relative to FIG. 2. FIG. 11 shows fluid flow to the impeller after passing through motor 130. By this arrangement, motor 130 is cooled by the fluid flowing through it. Fluid flow for this pump arrangement differs from that illustrated in FIG. 1. Fluid enters through openings located in the housing of motor 130 as shown by arrows 128, 129, and passes internal to motor 130 thereby cooling motor 130. The fluid then enters through an opening in annular ring 136, passes between centrifugal impeller blades 133, and exits from centrifugal impeller blades 133. Fluid then enters annular vortex channel 141 by going around baffle or sealing member 140 at two diametrically spaced apart locations. The fluid is then moved by vortex impeller blades 135 to two partitions 138 (one not shown) where it is exhausted through exhaust openings 137. It is also noted that a view taken in the direction of arrows 2'—2' on FIG. 11 would show the location of partitions 138 in relation to other parts of FIG. 11 to be substantially similar to the relationships of similar parts in FIG. 2.

FIG. 11, as illustrated, shows the fluid entering the motor near the top of the motor housing but it will be understood that fluid could enter by way of openings at other locations of the motor housing. Other structural details of series wound motor 130 are not described since they will be understood by persons of ordinary skill in the art.

Centrifugal impeller blades 133 extend to the outer diameter of rotor disc 132. Thus the centrifugal impeller blades 133 use the full diameter of the rotor; and the longer the blades, the greater the flow created. Vortex impeller blades 135 are located on the opposite side of rotor disc 132 from centrifugal impeller blades 133. The vortex impeller blades 135 are positioned toward the outer periphery of rotor disc 132, thereby allowing these blades to also benefit from the maximum diameter of the rotor since the greater the radius the greater the velocity of the blades. Therefore by constructing the centrifugal blades on one side of the rotor and the vortex blades on the other side a more compact impeller is obtained and the disadvantage of having a smaller diameter for one set of blades, where the two different types of blades are on the same side of the rotor is overcome.

A centrifugal-dual path pump unit similar to that shown in FIG. 11 was used to obtain the data from which the curve 122 was plotted in FIG. 9.

It will be understood that constructions such as those shown in FIG. 11 may be used for a number of different applications. For example, when it is desired to use the construction of FIG. 11 to establish low pressure or vacuum type conditions (as may be encountered for example in vacuum cleaner applications), the outlets from the vortex channels may be vented to atmosphere and the inlet side of the construction may be disposed in a chamber in which a desired low pressure condition is to be maintained. This chamber may be, for example, one that contains a suitable type of filter and/or bag that would accumulate dust or dirt that may be moved thereinto because of the low pressure conditions.

On the other hand, the construction of FIG. 11 may be utilized when desired in equipment with which it is desired to establish high pressure conditions. For example, in dispensing applications where a source of high pressure air is needed, the structure of FIG. 11 may be arranged so that the discharge from the vortex outlets will flow into a tank or plenum, from which the high pressure fluid may then be diverted to spraying or other dispensing type apparatus.

It will be understood that a single vortex path pump would only have one partition in the vortex channel and therefore only one discharge opening.

Applications requiring a higher head at essentially the same impeller r.p.m. might use two concentric vortex paths. Or if the same head and flow is desired, by having two concentric vortex paths, a lower r.p.m. could be used thereby resulting in lower noise and longer drive motor bearing life.

Figure 12:
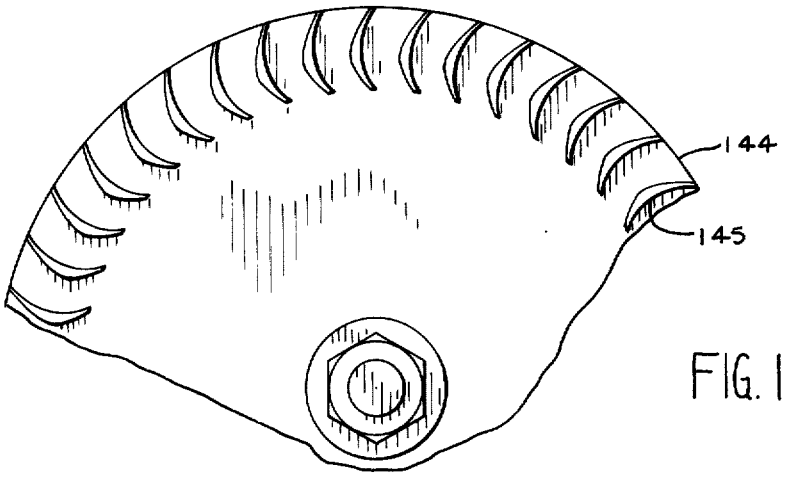
FIG. 12 is a partial view of a vortex impeller having curved or airfoil blades.

FIG. 12 shows blades of a vortex impeller 144 that also has been made and tested. Impeller 144 has curved or airfoil blades 145 on its periphery. This impeller 144 produced a higher head than one having straight vortex blades, but was approximately 2 percent less efficient. Impeller 144 was constructed with 60 blades 145 equally spaced.

The provision of dual 180° vortex paths reduces the effective length of the vortex paths by ½ as compared to a 360° single path, and provides a substantial increase in the flow rate capability and efficiency of a pump without a significant corresponding reduction in head capability.

While a double path vortex pump has been shown and described, it will be understood that more than two vortex sections may be provided. Improved multiple path vortex pumps embodying the present invention may be employed in vacuum cleaners as well as in compressor or evacuator applications. While multiple path vortex pumps embodying the invention may more commonly be used in air moving applications, it will be readily understood that they are suitable for moving other gaseous and liquid mediums. It will be further understood that although an electric motor has been shown as the drive means for the pump, other means could just as easily be utilized to rotate the pump impeller.

It now will be understood that I have provided new and improved arrangements that may include at least one vortex channel in the form of a hollow toriodally shaped channel having a circumferential opening. Vortex impeller blades extend into the vortex channel through the opening and impart a motion to fluid in the channel as the impeller rotates. In more preferred forms, partitions divide the channel into a plurality of sections, and an exhaust opening is provided adjacent each partition to exhaust the fluid as it approaches the partition. The partitions will have a slot cut therein just large enough to allow the vortex impeller blades to pass into a next adjacent section of the vortex channel. A baffle or seal extends for a short distance into each next adjacent section flush with the slot of such partition and forms a groove for the vortex impeller blades. Preferably, this seal extends for at least an arcuate length equal to two vortex blades. The number of vortex blades may be 50 to 60 equally spaced blades.

In other forms, fluid from a centrifugal impeller is exhausted around at least one baffle into the vortex channel as the vortex impeller blades move beyond a groove formed by a baffle, and the fluid in the vortex channel is moved until a partition is reached at which time the fluid is again exhausted.

A centrifugal-vortex pump having one vortex channel has been tested. The single vortex channel pump had a higher head than a dual channel pump at low flow rates, but the single channel vortex head dropped off relatively rapidly for high flow rates.

Reviewing once again the curves illustrated in FIGS. 9 and 10, it is noted that with constructions that embody the present invention in preferred forms, advantageous and beneficial results may be obtained. More specifically, such structures have operational characteristics that one ordinarily would not expect. For example, substantially the only difference in the constructions from which the test data was obtained for curves 122 and 121, was that the construction corresponding to curve 122 included a dual path vortex channel; whereas the construction corresponding to curve 121 involved a single channel, substantially 360 mechanical degree, vortex path. It will be noted, when these two curves are compared, that a head of only about 93 inches of water was obtained under no flow conditions for the dual path pump; whereas a head of about 147.5 inches of water was obtained under no flow conditions for the single path pump. On the other hand, for head conditions of 30 inches of water, the dual path flow rate was about 75 cubic feet per minute; whereas the single path flow rate was only about 40 cubic feet per minute. While it might be expected that the head for curve 121 would be greater than the head for curve 122 under no flow conditions it is believed that it is unexpected for the large improvement in flow characteristics for curve 122 at 30 inches of water head. More significantly, the head versus flow characteristics are significantly better at a flow rate of 50 cubic feet per minute as compared to what usually is considered to be minimally desirable for vacuum cleaner blowers. More specifically, in vacuum cleaner blower applications, an airflow of about 50 cubic feet per minute at 50 inches of water head is usually considered a minimum requirement.

The data for curve 122 was obtained from a test of a system substantially as shown in FIG. 11. The data for curve 121, on the other hand, was obtained by testing a centrifugally boosted single path vortex pump that was driven by a dynamometer in a manner to simulate the speed characteristics of the series motor used in the system from which data for curve 122 was derived.

Referring now to FIG. 10, it will be appreciated that the unexpected benefits that may be obtained from the present invention may also be utilized to advantage with vortex pump sections per se. It is again noted that the curves 124, 126 in FIG. 10 represent the performance of vortex pumps that are not combined with centrifugal type pumps.

The curve 124 represents test data for the head-flow characteristics of a single channel vortex pump having the channel extending for substantially 360°. The curve 126, on the other hand, represents test data where the unit was constructed by utilizing my teachings of providing a dual path for a single impeller, with each path extending for approximately 180 mechanical degrees. It will be noted that under no flow conditions the dual path unit developed a head of approximately 68 inches of water as compared to a head of about 101 inches of water for the single path vortex unit. On the other hand, substantially improved and much greater flow rates were obtained for the dual path unit as compared to the single path unit at heads of less than about 50 inches of water. These results, it is believed, represent a significant advantage and should be well noted.

Figure 13:
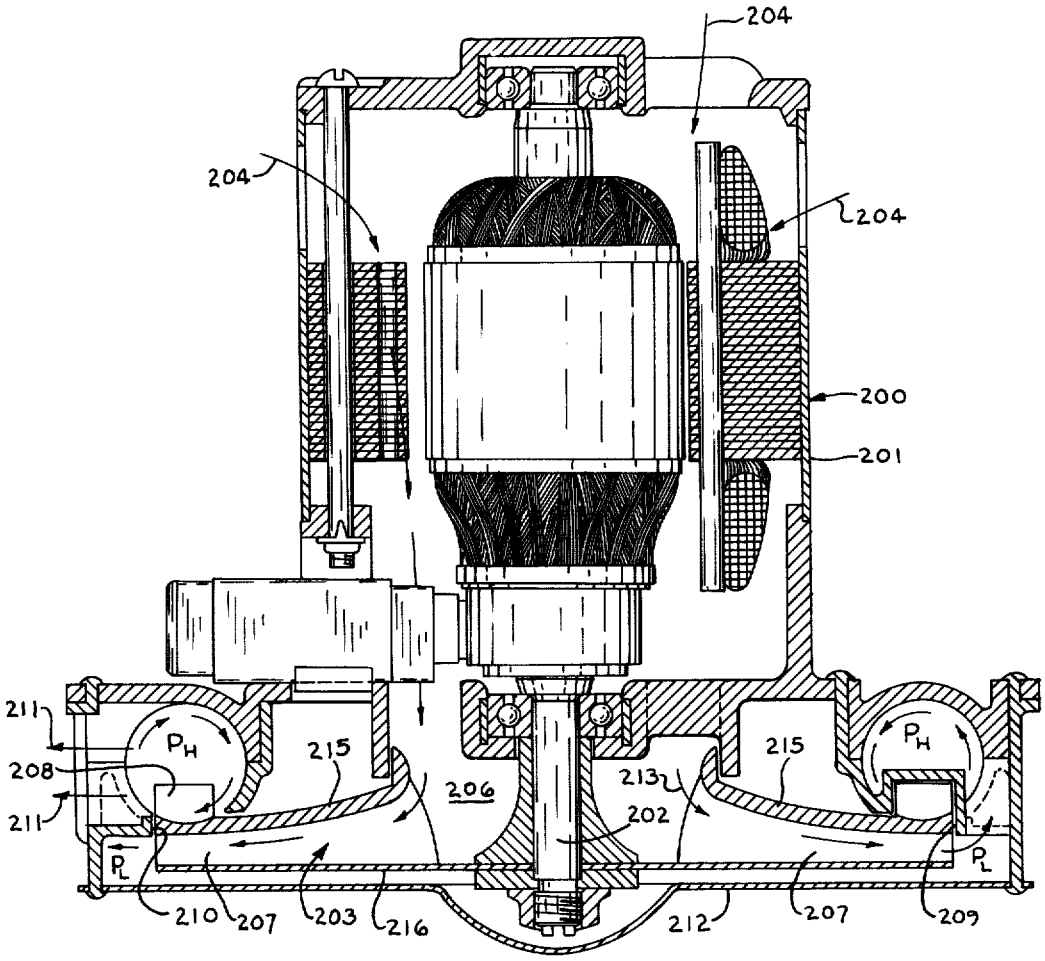
FIG. 13 is a cross-sectional view showing yet another embodiment of the present invention.

In FIG. 13 a centrifugal-dual path vortex pump system 200 is illustrated. In this system, a series motor 201 drives an impeller assembly 203 by means of the motor shaft 202. The impeller assembly 203 in FIG. 13 is inverted relative to the motor 201 as compared to the relationships between the motor and impeller assemblies shown in FIGS. 1 and 11. The disc 215 carries impeller elements of both centrifugal and vortex type. Cover plate 216 corresponds to, and functions similarly to cover plates 56, 136 in FIGS. 1, 11 respectively with the exception that cover plate 216 does not have a fluid passage opening. It will be noted that disc 215 is a single member as compared to a composite disc of the type shown in FIG. 11.

In FIG. 13, fluid is admitted to the interior of the motor as represented by arrows 204. The fluid then is admitted to the eye 206 of the centrifugal pump section and compressed by the centrifugal impeller blade elements 207. The fluid subsequently is discharged at a first pressure region $P_L$ and flows into the vortex channels where the vortex impeller elements 208 further compress the fluid and establish a higher pressure region $P_H$. Because of the difference in pressures between the pressure regions $P_H$ and $P_L$, running seal leakage losses occur as the pressures tend to equalize. This leakage occurs along the running seal regions 209, 210.

With the arrangement shown in FIG. 13, this pressure equalization occurs at start-up of the system, and thereafter the pressure equalization takes place such that there is no continuing high pressure fluid leakage from the system. On the other hand, with the systems shown in FIGS. 1 and 11 similar pressure equalization causes continuing high pressure fluid losses from the system during operation.

The high pressure fluid in the system of FIG. 13, is ultimately discharged in a direction as indicated by the arrows 211; but it should be noted that any suitable baffling arrangement may be used to control the direction and location of air flow from the system 200.

The above will now be restated in a somewhat different manner. Initially, note the inversion of the vortex impeller blades relative to the centrifugal impeller blades as compared to the construction shown in FIGS. 1 and 11. When a finite mass of fluid is discharged by the impeller blade elements 207 to the pressure region $P_L$, and then moves into the higher pressure regions $P_H$, at least some small portion of such finite mass of fluid will leak back to pressure regions $P_L$ along the running seal regions 209, 210. However, this leakage mass may not escape to atmosphere because of the location of sealing cover or plate 212. The only other mode of escape for this small portion of the fluid would be for it to flow in a reversed direction relative to the arrows 213 (along centrifugal blade elements 207) and back through the interior of the motor to atmosphere. Thus, with the arrangement shown in FIG. 13, a relatively long and pressurized tortuous path would have to be followed by any fluid that would be escaping from the relatively high pressure regions $P_H$. Thus, after, operation has commenced for system 200, fluid escaping from pressure regions $P_H$ to regions $P_L$ acutally increases the pressure in regions $P_L$ so that the actual pressure differential therebetween (if any) is relatively small.

While there has been described above preferred embodiments of the invention, it will be understood that numerous changes may be made therein. For example, blade driving means of impeller assemblies may be in the form of a rotor member (or assembly) or disc with impeller blades on opposite sides thereof, and such disc may be of a composite structure of two separately manufactured impeller blade supports. Alternatively, the impeller may be cast in one mold and then an annular cover added over the centrifugal blades. Also, the impeller assembly of FIG. 13 can be cast in one molding and then a flat plate or cover added over the centrifugal blades. The impeller assembly is enclosed in a casing or housing which also forms vortex paths or channels having exhaust or discharge openings therein. Accordingly, it is to be clearly understood that this description is made only by way of example and not as a limitation to the scope of the invention.

What I claim as new and desire to secure by Letters Patent of the United States is:

1. A multiple path vortex pump comprising a casing and a rotor assembly in the casing having a first side and a second side; the first side of the rotor assembly having centrifugal impeller blades therealong and the second side of the rotor assembly having a plurality of vortex impeller blade elements therealong; the casing having an inlet opening therein for admitting fluid medium to the centrifugal impeller blades, a first portion forming an exhaust region for fluid discharged from the centrifugal impeller blades, a second portion forming a vortex pathway along an annular pathway for the vortex impeller blade elements, and means for dividing the vortex channel into a plurality of vortex channel part-annular sections; said casing having at least one portion for defining passage means constraining fluid to move from the exhaust region to the plurality of part-annular sections for admitting fluid medium from the centrifugal impeller blades to the part-annular sections so that substantially all of the fluid exhausted to the exhaust region is admitted to the plurality of part-annular sections, the second portion of the casing having discharge means therein through which the fluid medium previously exhausted from the centrifugal impeller blades is discharged from the vortex channel part-annular sections.

2. A multiple path vortex pump comprising a casing and a rotor assembly in the casing having a first side and a second side; the first side of the rotor assembly having centrifugal impeller blades therealong and the second side of the rotor assembly having a plurality of vortex impeller blade elements therealong; the casing having an inlet opening therein for admitting fluid medium to the centrifugal impeller blades, a first portion forming an exhaust region for fluid discharged from the centrifugal impeller blades, a second portion forming a vortex channel along an annular pathway for the vortex impeller blade elements, and means for dividing the vortex channel into a plurality of vortex channel part-annular sections; said casing having at least one portion for defining passage means constraining fluid to move from the exhaust region to the plurality of part-annular sections for admitting fluid medium from the centrifugal impeller blades to the part-annular sections, and the second portion of the casing having discharge opening means therein through which a fluid medium may be discharged from the vortex channel part-annular sections; the vortex channel part-annular sections being of generally equal circumferential extent, each of the vortex channel part-annular sections having opposite ends, the passage means communicating with each respective vortex channel section adjacent one end thereof, and the discharge opening means communicating with a respective vortex channel section adjacent the other end thereof.

3. The pump of claim 2 wherein there are two of said vortex part-annular channel sections.

4. The pump of claim 2 wherein said casing includes a third portion having said discharge openings communicating therewith and forming a discharge plenum chamber for said vortex impeller, said third casing portion having an exhaust opening therein.

5. The pump of claim 2 wherein said rotor assembly comprises a disc element having opposite sides, said centrifugal impeller blades being carried on one of said sides, and said vortex impeller blade elements being carried on the other of said sides adjacent the periphery of said disc element.

6. The pump of claim 5 further comprising a motor coaxial with said rotor assembly and operatively coupled thereto, said motor being disposed on said other side of said disc element.

7. The pump of claim 6 wherein said second casing portion surrounds said motor and the outer diameter of the vortex impeller is substantially the same as the outer diameter of the centrifugal impeller.

8. The pump of claim 2 wherein said casing includes a first section having a part of the vortex channel formed therein and a second section having the remainder of the vortex channel formed therein, said dividing means comprising a plurality of angularly spaced partition elements formed on one of said casing sections, said first casing section having a plurality of annular slots formed therein respectively separated by bridging portions and respectively communicating with said vortex channel sections, said vortex blade elements extending through said slots into said vortex channel sections, said vortex blade elements passing over said bridging portions, and said partition elements being respectively aligned with said bridging portions.

9. The pump of claim 8 wherein said partition elements are formed on said bridging portions, said opposite ends of said vortex channel sections are respectively formed by said partition elements, said first casing section has an outer wall and an inner portion defining said slots therebetween and joined by said bridging portions, said first casing section having baffle portions each joined to a respective bridging portion and said inner portion and respectively overlying one end of each of said vortex channel sections, said vortex impeller blade elements passing over said baffle portions, each of said baffle portions defining one end of a respective slot with the other end of the respective slot being defined by a bridging portion, and said baffle portions being spaced from said outer wall and respectively defining portions of said discharge opening means.

10. The pump of claim 9 wherein each of said bridging and baffle portions has a groove formed therein, said vortex impeller blade elements extend into said groove, said rotor member is mounted on a shaft; and further comprising a bearing mounted on said inner portion of said first casing section and rotatably supporting said shaft; said casing including a third section enclosing said centrifugal impeller blades and having an outer wall connected to said outer wall of said first casing section, said outer walls being spaced from the outer periphery of said centrifugal impeller to form a plenum chamber, said inlet opening being formed in said third casing section coaxial with said shaft; said casing including a fourth section connected to said second casing section and having said discharge openings communicating therewith and forming a discharge plenum chamber for said vortex impeller, and said fourth casing section having an exhaust opening therein.

11. A centrifugal-vortex pump comprising: a housing; a rotary impeller disposed within said housing and being mounted on a shaft extending through said housing; said impeller being formed of a disc having a first and a second side with the first side having centrifugal blades projecting along said impeller to its periphery and the second side having vortex blades on its periphery; said centrifugal blades having an annular cover disposed thereover; said annular cover being open in the center to allow passage of a fluid to said centrifugal blades and the cover opening being in alignment with an opening in said housing; said housing further having a toroidal vortex channel with a circumferential opening to accommodate the vortex blades, and also having a centrifugal exhaust region for constraining compressed fluid exhausted by the centrifugal blades to flow into the vortex channel; said toroidal vortex channel having at least two partitions dividing said channel into at least two sections of substantially equal circumferential extent; said vortex channel further having a corresponding discharge opening to exhaust fluid arriving at the at least two partitions and also having an opening past the at least two partitions allowing fluid discharge from said centrifugal blades to enter said vortex channel; and a drive means connected to said vortex impeller shaft.

12. The centrifugal-vortex pump of claim 11 wherein said drive means is an electric motor mounted over the opening in said housing and having at least one inlet opening in said motor thereby to permit fluid to pass through said motor prior to reaching the pump.

* * * * *